US005927017A

United States Patent [19]

Jacobs et al.

[11] Patent Number: 5,927,017

[45] Date of Patent: Jul. 27, 1999

[54] SLIDING DOOR BOTTOM ROLLER ASSEMBLY WITH A ROTATABLE ANTI-JUMP MEMBER

[75] Inventors: Kenneth Jacobs, Bramley; Auguste Joseph Menard, Swindon, both of United Kingdom

[73] Assignee: The Stanley Works, New Britain, Conn.

[21] Appl. No.: 09/016,871

[22] Filed: Jan. 30, 1998

[51] Int. Cl.[6] ..... E05D 13/00

[52] U.S. Cl. ..... 49/410; 49/425; 49/417; 16/96 R

[58] Field of Search ..... 49/425, 410, 409, 49/417, 148; 16/90, 91, 96 R

[56] References Cited

U.S. PATENT DOCUMENTS

| | | | |
|---|---|---|---|
| 1,328,043 | 1/1920 | Hill . | |
| 1,934,429 | 11/1933 | Fairhurst | 49/127 |
| 2,677,154 | 5/1954 | Agle . | |
| 2,944,282 | 7/1960 | Greco | 16/87 R |
| 3,033,285 | 5/1962 | Banner . | |
| 3,167,112 | 1/1965 | Tucker . | |
| 3,397,487 | 8/1968 | Hunt et al. . | |
| 3,526,995 | 9/1970 | Saunders . | |
| 3,650,071 | 3/1972 | Tanner | 49/411 |
| 3,683,451 | 8/1972 | Tanner | 16/90 |
| 3,701,179 | 10/1972 | Cox | 16/90 |
| 3,745,706 | 7/1973 | Stermac . | |
| 3,956,854 | 5/1976 | Yamamoto . | |
| 4,064,592 | 12/1977 | Riegelman et al. | 16/100 |
| 4,123,874 | 11/1978 | Scott | 49/411 |
| 4,178,857 | 12/1979 | Madland . | |
| 4,351,131 | 9/1982 | Kubik . | |
| 4,633,615 | 1/1987 | Moose . | |
| 4,639,970 | 2/1987 | Adams . | |
| 5,148,630 | 9/1992 | Llorens . | |
| 5,488,803 | 2/1996 | George | 49/425 |
| 5,584,142 | 12/1996 | Spiess . | |
| 5,598,606 | 2/1997 | Jacobs . | |
| 5,598,665 | 2/1997 | Guddas . | |
| 5,673,516 | 10/1997 | Hughes et al. | 49/425 |

FOREIGN PATENT DOCUMENTS

| | | |
|---|---|---|
| 2-120487 | 8/1990 | Japan . |

*Primary Examiner*—Daniel P. Stodola
*Assistant Examiner*—Gregory J. Strimbu

[57] ABSTRACT

A roller assembly for a sliding door that slides along a track includes an anti-jump member engageable with the track to prevent the roller assembly from derailing. The roller assembly comprises a bracket adapted for attachment to the door, a roller mounting member slidably seated in the bracket, and a roller rotatably mounted on the roller mounting member for travel along the track. The anti-jump member is pivotably supported in and displaceably carried by the roller mounting member for movement between an extended operative position wherein an engagement portion on the lower end thereof rides in the track, and a retracted inoperative position, wherein the engagement portion is spaced upwardly from the track. The roller assembly is operable to slide the door with the anti-jump member in either the operative position or the retracted position.

5 Claims, 4 Drawing Sheets

SLIDING DOOR BOTTOM ROLLER ASSEMBLY WITH A ROTATABLE ANTI-JUMP MEMBER

BACKGROUND OF THE INVENTION

The present invention relates to roller assemblies for sliding doors which that slide along a track, and, more particularly, to an anti-jump member engageable with the track to prevent the roller assembly from derailing.

Roller assemblies for sliding doors that move along a track are known in the art. Advantageously, such a roller assembly may comprise a bracket for attachment to the door, a roller mounting member slidably seated in the bracket and a roller mounted on the roller mounting member for travel along the track. An improved roller assembly of this type is disclosed in U.S. Ser. No. 08/583,281, now U.S. Pat. No. 5,673,516, assigned to the assignee hereof.

A problem common to all such roller assemblies is derailing, which may occur if the door is struck or bumped, or if it encounters an obstruction on the track, or if force is not applied parallel to the track when the door is being opened or closed. The problem is exacerbated if the door is installed in a doorway which varies in height from one jamb to the other jamb or if the jambs are not plumb.

Many sliding doors are intended for installation by the user, the so called "do-it-yourself" market. Products in this market must be simple to install, using only commonly available tools.

Accordingly, it is an object of the present invention to provide a novel roller assembly for a tracked sliding door which resists derailing.

It is also an object to provide such a roller assembly which is specifically adapted for user installation.

Another object is to provide such an assembly which is quiet in operation and inexpensive to produce.

SUMMARY OF THE INVENTION

It has now been found that the foregoing and related objects may be readily attained in a roller assembly of the type which includes a bracket adapted for attachment to the door, a roller mounting member slidably seated in the bracket, and a roller rotatably mounted on the roller mounting member for travel along a track extending adjacent the bottom of the doors and formed at the top with two shoulders on either side of a central cavity.

An anti-jump member is provided which is engageable with the track to prevent the roller from derailing. The anti-jump member is displaceably carried by the roller mounting member for movement between an operative position whereat it engages the track, and a retracted position whereat it does not engage the track. The anti-jump member is displaced both translationally and rotationally in moving vertically from the retracted position to the operative position and vice versa. The roller assembly is operable to slide the door with the anti-jump member in either the operative position or the retracted position. The roller has a circular central portion providing the rim flanked by two coaxial circular side portions of smaller diameter than the central portion.

The anti-jump member includes a handle and an elongate shaft which extends from the handle and terminates in an enlarged track engagement member. A detent is provided for releaseably retaining the anti-jump member in the retracted position and in the operative position.

Advantageously, the roller mounting member, the roller and the anti-jump member are formed from a synthetic resin.

The roller comprises a wheel and an integrally molded axle. The roller is snap fitted to the roller mounting member.

DETAILED DESCRIPTION OF THE PREFERRED EMBODIMENTS

Figure 5:
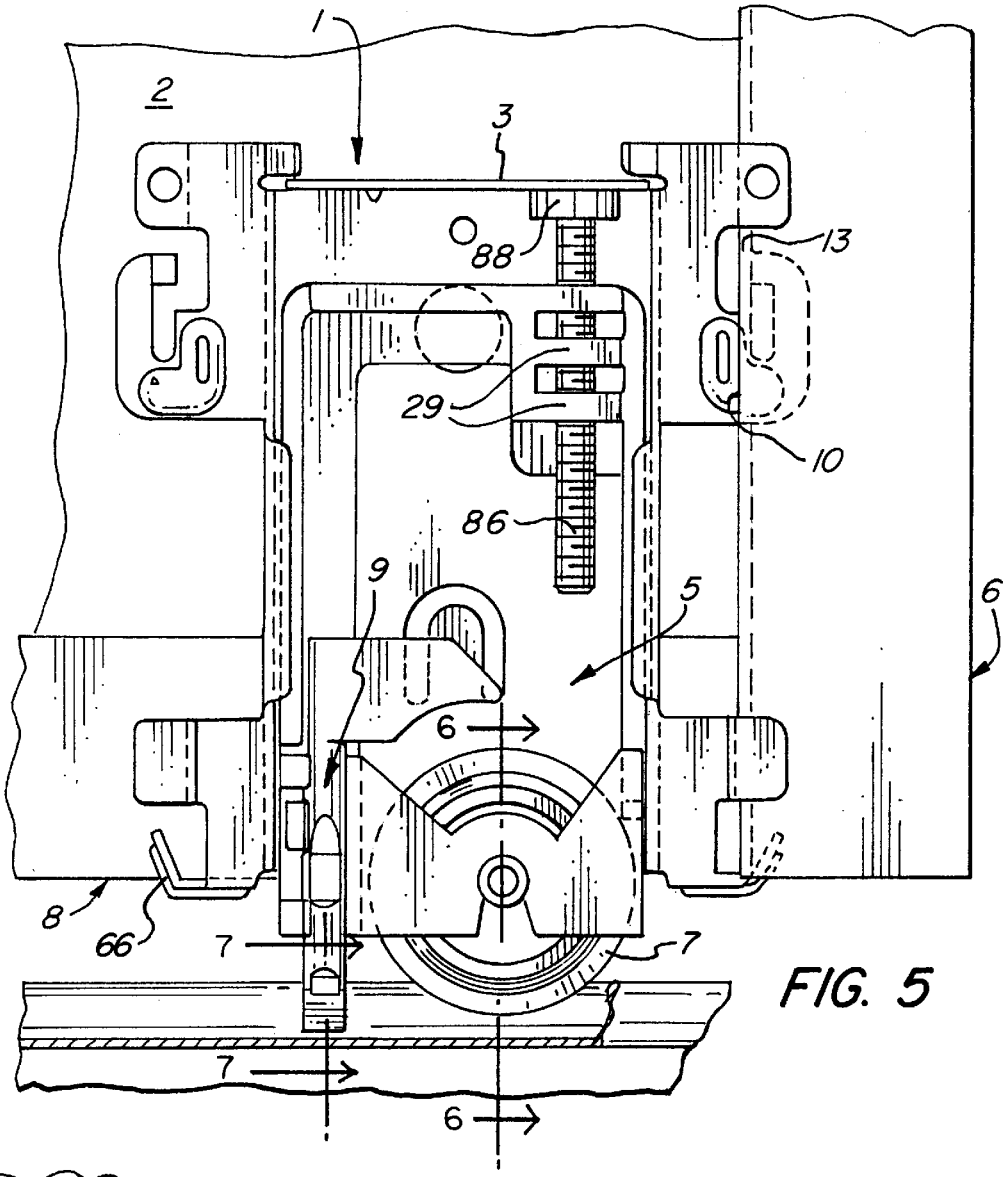
FIG. 5 is a front elevational view of the roller assembly embodying the present invention attached to a door and sliding in a track.

Turning first to FIG. 5 of the attached drawings, therein illustrated is a roller assembly for sliding doors embodying the present invention and generally designated by the numeral 1. Roller assembly 1 comprises a bracket 3, a roller mounting member 5 slideably seated in the bracket 3, a roller 7 rotatably mounted on the roller mounting member 5, and an anti-jump member 9 carried by the roller mounting member 5.

The bracket 3 has a generally planar body portion 24 having an inner surface 17 upon which the roller mounting member 5 is slidable. Along the sides thereof are side walls 26 each having outwardly extending flanges 38 and 40 at the ends thereof and an inwardly extending lip 28 centrally thereof. The side walls 26 and the body portion 24 define a channel in which the roller mounting member 5 is seated, and the lip 28 retains the roller mounting member 5 therein.

An end wall 30 extends perpendicularly to the upper end of the body portion 24 transversely across the width thereof between the side walls 26 to close the channel at its upper end. A flange 32 extends perpendicularly to the other or lower end of the bracket body portion 24 at its other end and in a direction opposite to the side walls 26 and end wall 30. Along the free end of the flange 32 is a pair of holding tabs 34 which extend parallel to the plane of the body portion 24 and seat in the slots 12 in the bottom wall of the door rail 8. While illustrated as part of the bracket 3, it should be understood that the holding tabs 34 on the flange 32 may be omitted, or removed or flattened, and the flange 32 may be connected to the rail 8 by screws passing through openings 31 in the flange 32 when the rail 8 is not adapted to receive the tabs 34, such as when the frame is formed from a hardwood greater than the thickness for which its channel was intended.

The upper side flanges 38 on the bracket 3 and the lower side flanges 40 have generally planar body portions 42 and 44 extending generally parallel to the plane of the body portion 24. The planar body portion 42 of the flange 38 is formed with a generally G-shaped tab 50 which has a free end providing an inturned snap tip 51. The tabs 50 are generally coplanar with the planar portion 42 except for the snap tip 51 which is angled towards the plane of the body portion 24. This allows the tip 51 to pass into the slot 10 formed in the side of the door stile 6 and thereafter snap in place behind the interior surface of its side wall 13. An upwardly offset tab 52 on the flange 38 extends in a plane generally parallel to the plane of the bracket body portion 24 and is spaced above the plane of the planar portion 42. This cooperates with the G-shaped tab 50 and bears against the outer surface of the stile 6 to capture it therebetween.

Each G-shaped tab 50 is provided with weakening section 56 which permits the tab 50 to be broken off in the event that the stile 6 is cut adjacent its end so that the slot 10 is no longer present or aligned therewith. In this circumstance, the offset tab 52 is connected to the stile 6 by a screw (not shown) which extends through an aperture 54 in the tab 52. The weakening section 56 has an L-shaped slot 58 and a deformed region surrounding the slot 58 which allows the tab 50 to be broken off when a tool, such as a screwdriver tip, is inserted therein and moved back to flex the tab 50 until it breaks off.

Each flange 42 also includes a notch 60 which receives the upper end wall 30 therewithin. Thus, the flange 42 has a portion 62 which extends behind the end wall 30 so as to abut the outer face of the end wall 30 and provide it with enhanced load bearing capacity. This is important because the weight of the door bears on the end wall 30 by forces imparted to it through the machine screw 86. The juncture of the body portion 24 and end wall 30 may be further stiffened by providing spot welds or staking gussets 64 therealong.

The lower end flange 40 secures the lower end of the bracket 3 to the open end of the stile 6. The lower end flange 40 includes at its lower end an arm portion 65 which extends outwardly of and perpendicularly to the planar body portion 40 and provides a tab 66 which extends upwardly so as to engage the inner surface of the stile 6. At its upper end, the flange 40 has an upwardly offset, outwardly extending tab 53 which extends parallel to the body portion 24 along the outer surface of the stile 6. The tab 66 works in conjunction with the offset tab 53 to seat the wall of the stile 6 therebetween.

The roller mounting member 5 is cooperatively dimensioned to slidingly seat in the channel of the bracket 3 and has a generally rectangular configuration with its upper end portion seated within the channel of the bracket 3 and its lower end portion extending below the bracket 3. The roller mounting member 5 has spaced side walls 76 and 78 which extend generally parallel to the plane of the body portion 24 of the bracket 3 and an end wall 82 at its upper end.

The end wall 82 of the roller mounting member 5 is provided with an aperture 84 which threadably seats a machine screw 86 having a head 88 which abuts against the lower surface of the end wall 30 of the bracket 3 to transfer the door load to it. The end wall 82 is provided with reinforcements 29 adjacent the aperture 84. The screw 86 enables adjustment of the position of the roller mounting member 5 and thereby the door height above the supporting surface and reduces play in the door by allowing the door to be moved upwardly snugly against the upper track (not shown). The end wall 30 has an access aperture 90 therein which permits a screwdriver blade to be inserted through the end wall 30 of the bracket 3 to engage the head 88 of the screw 86 in order to make such adjustments.

Figure 1:
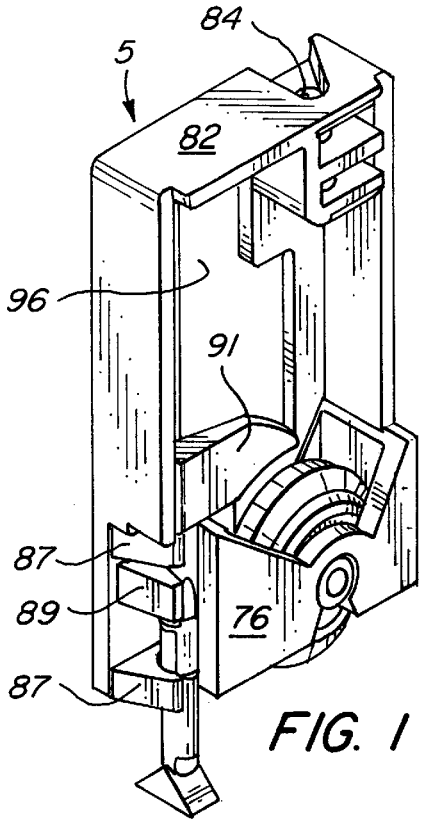
FIG. 1 is a perspective view of the roller mounting member, roller and anti-jump member of a roller assembly embodying the present invention.
Figure 2:
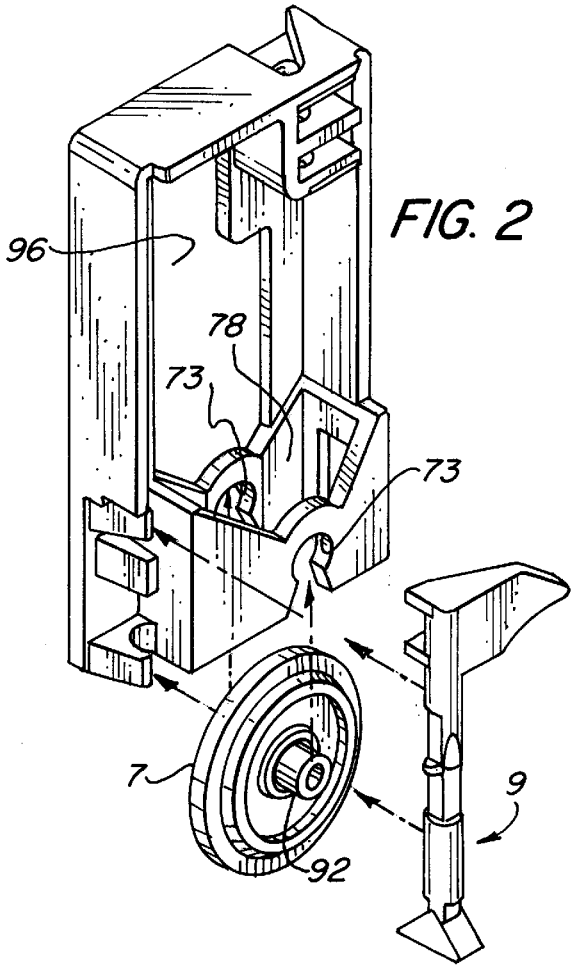
FIG. 2 is an exploded perspective view of the structure shown in FIG. 1.
Figure 14:
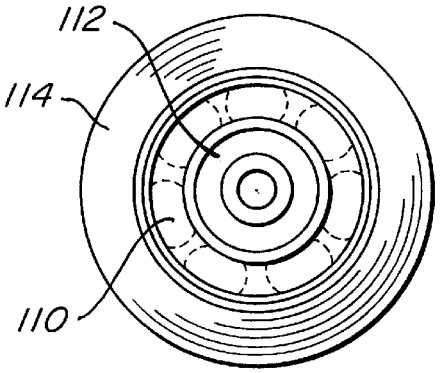
FIG. 14 is a plan view of an alternate roller structure.

As best seen in FIGS. 1 and 2, the roller 7 is rotatably mounted adjacent the lower end of the mounting member 5 on an integral shaft or axle 92 which extends through aligned apertures in the side walls 76 and 78. As seen in FIG. 2, each of the apertures 73 includes an enlarged guide portion which allows the hub of the roller 7 to be snapped into place in the mounting member 5. Alternatively, a ball bearing 110 may be utilized between the roller hub 112 and the roller tire 114 as illustrated in FIG. 14.

Figure 6:
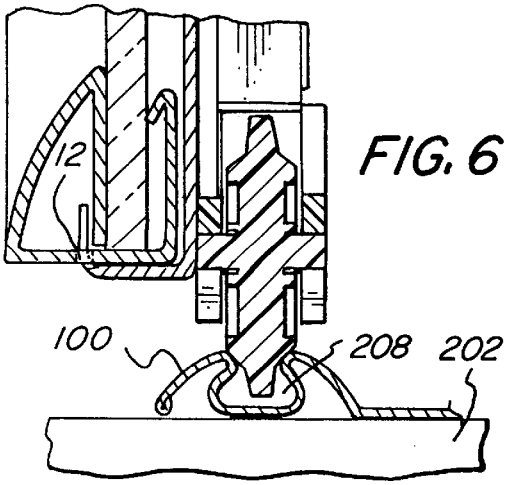
FIG. 6 is a sectional view along the line 6—6 of FIG. 5.

As clearly shown in the drawings, and particularly FIG. 6, the roller 7 comprises a wheel 7' integrally molded with the axle 92. The wheel 7' comprises a circular central portion 7*a*, providing a rim flanked by two coaxial, circular frustroconical, side portions 7*b*,7*c*. The side portions 7*b*, 7*c* are of smaller diameter than the central portion 7*a* and each side portion 7*b*,7*c* tapers axially outwardly to a smaller diameter, that is, in a direction away from the central portion 7*a*. As shown best in FIGS. 6 and 7, the track 100, resting on a base 202, is formed with two curved shoulders 204, 206 on either side of a curved central cavity 208. The two shoulders 204, 206 are situated at the top of the track 100, above the level of the base 202. The roller 7 rolls on the track 100 by virtue of the side portions 7*b*, 7*c* of the roller 7 rolling on the shoulders 204, 206 respectively. The open top of the central cavity 208 of the track 100 forms a slot 210, level with the two shoulders 204, 206 and the cavity 208 widens out below the two overhanging shoulders 204, 206. The central portion 7*a* of the roller 7 extends through the slot 210 and below the level of the two shoulders 204, 206 into the cavity 208.

The roller mounting member 5 is limited in its movement outwardly of the bracket 3 by a detent or tab 98 which extends inwardly from the body portion 24 and seats in an elongated slot 96 in the sidewall 78 of the roller mounting member 5. The detent 98 is resiliently deflectable to be deflected into the plane of the bracket body portion 24 when the upper end of the roller mounting member 5 is inserted into the bracket 3 until it springs into the slot 96 upon continued movement of the mounting member 5 toward the upper end flange 30 of the bracket 3.

Figure 3:
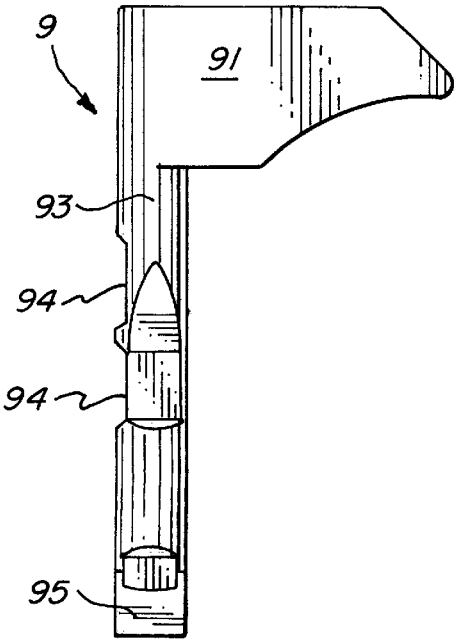
FIG. 3 is a front elevational view of the anti-jump member shown in FIGS. 1 and 2.
Figure 4:
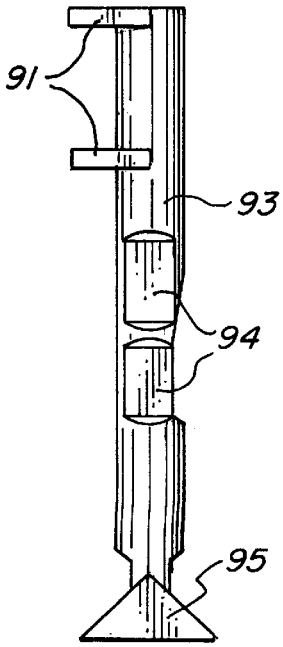
FIG. 4 is a side elevational view of the anti-jump member of FIG. 3.
Figure 9:
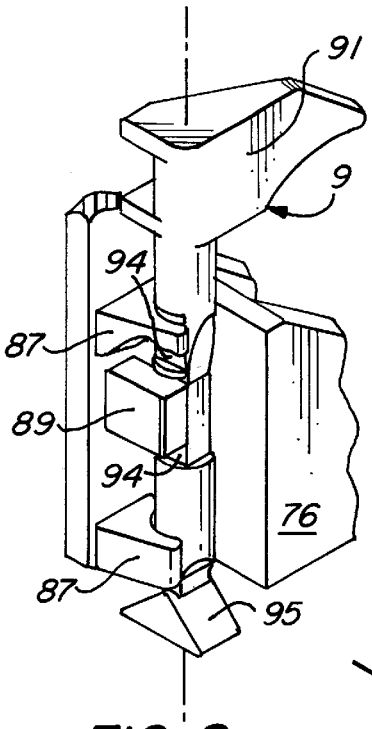
FIGS. 9–12 are a series of enlarged fragmentary views of the roller mounting member shown in FIG. 8 with an anti-jump member attached, showing the sequence of operating steps.
Figure 10:
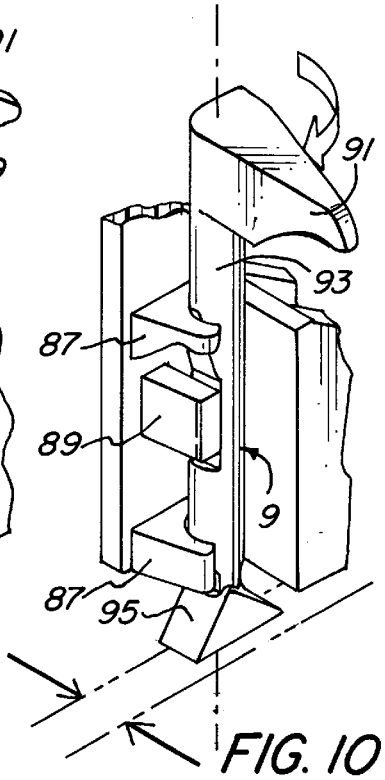
Figure 11:
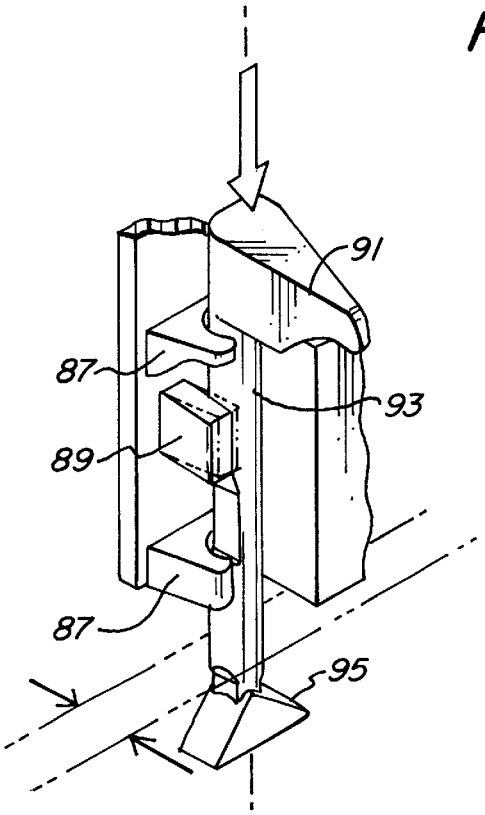
Figure 12:
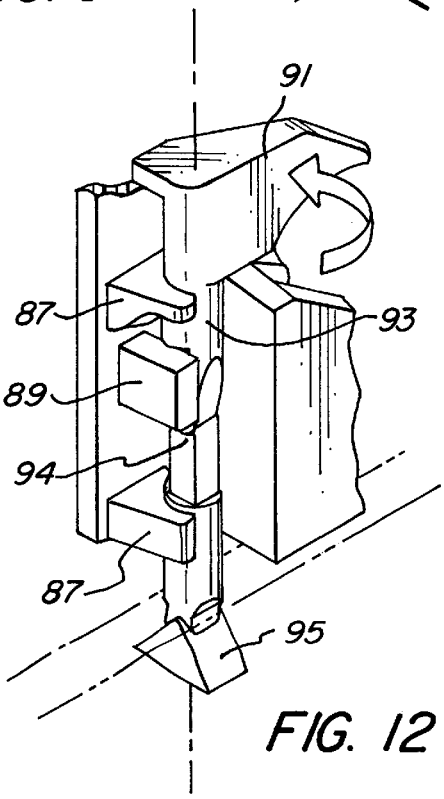
Figure 13:
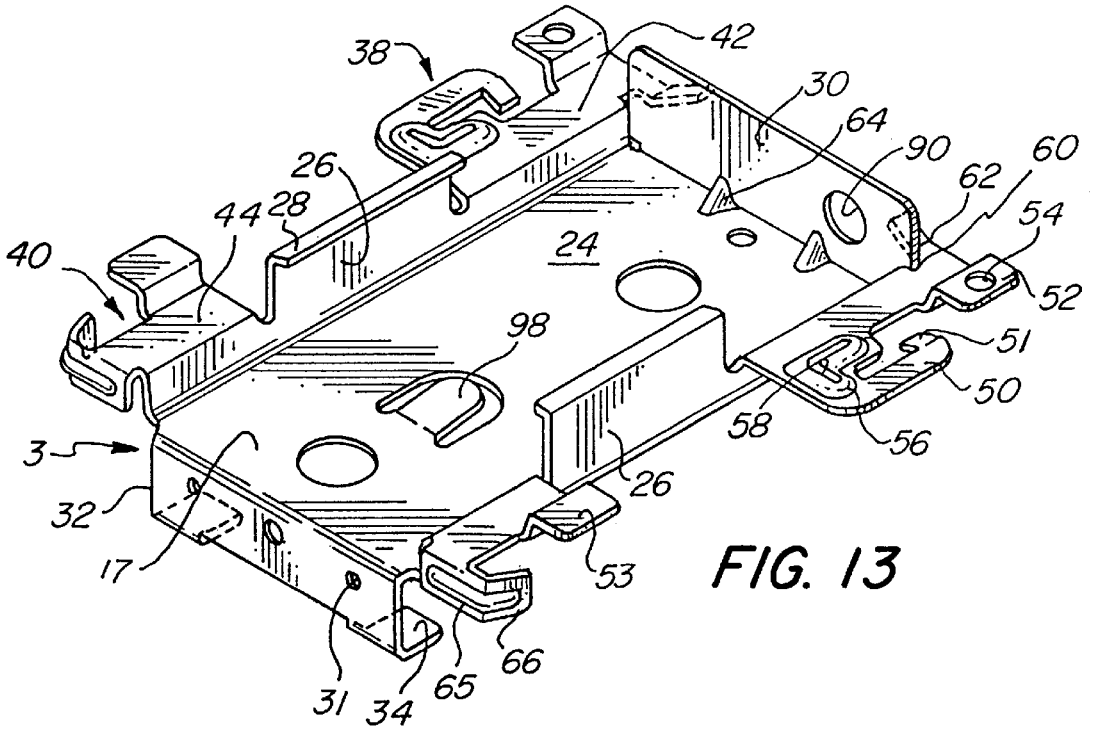
FIG. 13 is a perspective view of the bracket of a roller assembly embodying the present invention.

As best seen in FIGS. 3 and 4, the anti-jump member 9 includes a handle 91 and an elongated shaft 93 extending downwardly therefrom and terminating at its bottom end in an enlarged track engagement portion 95 which includes elongated extensions which extend along a longitudinal axis beyond the periphery of the shaft 93. The longitudinal axis of the extensions is perpendicular to an axis of the shaft 93. The anti-jump member 9 is rotatably and translatably carried by clips 87 on the side of the roller mounting member 5, adjacent the rim of the roller 7, with the shaft 93 lying in the roller median plane. As illustrated in FIGS. 9–12, the anti-jump member 9 is first rotated from the elevated position shown in FIG. 9 to the position of FIG. 10 in which it is still elevated, then displaced longitudinally downwardly to the lowered but inoperative position of FIG. 11 and, then rotated again wherein the track engagement portion 95 can engage the track 100, as best seen in FIG. 7.

Figure 7:
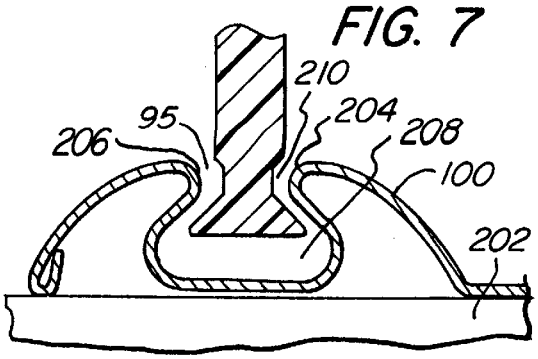
FIG. 7 is a sectional view along the line 7—7 of FIG. 5.
Figure 8:
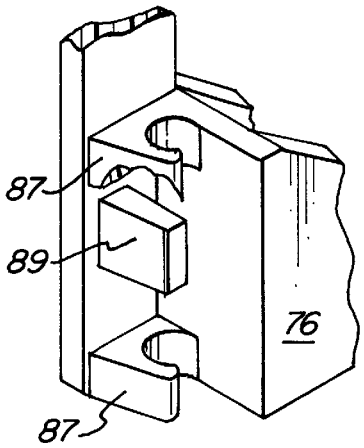
FIG. 8 is an enlarged fragmentary view of the roller mounting member of FIGS. 1 and 2.

In the lowered operative position of the anti-jump member 9 shown in FIGS. 7 and 12, the shoulders 204, 206 of the track 100 overhang the elongated extensions of the track engagement portion 95 as shown, so that the track engagement portion 95 cannot be withdrawn from the track 100. When the lowered anti-jump member is rotated to the lowered inoperative position shown in FIGS. 10 and 11, the shoulders 204, 206 of the track 100 no longer overhang any part of the track engagement portion 95 so that the track engagement portion 95 can be displaced longitudinally, i.e., vertically, to be inserted into or withdrawn from the cavity 208 through the slot 210, as desired. A pair of recessed, flattened portions 94 formed in the shaft 93 of the anti-jump member 9 are selectively engageable with a locking member 89 disposed between the clips 87 to releaseably retain the anti-jump member 9 in the retracted position or the operative position as desired. It will be appreciated that the roller assembly 1 can move freely along the tracks with the anti-jump member 9 in either the lowered position or the raised position.

In assembling the connector to the panel 2 and frame elements 6, 8, the roller mounting member 5 with the roller 7 mounted therein may be initially inserted into the channel of the bracket 3 until the detent 98 snaps into the slot 96 of the mounting member 5. Thereafter, depending on whether the connector is to be used in a right or left corner of the panel, the side flanges 38 and 40 disposed along the corresponding right or left lateral side of the bracket 3 are used in the connection. In the illustrated example of FIG. 5, the right corner of the door is being connected and those along the right side of the bracket 3 are used. The tab 66 is first engaged in the open end of the stile 6 and the tabs 34 of the lower end flange 32 are inserted into the slots 12. Thereafter, the bracket 3 is pivoted toward the slot 10 in the stile 6 until the G-shaped tab 50 is inserted through the slot 10 and the tip 51 snaps against the inner surface of the stile 6. Concurrently, the tabs 52, 53 seat against the outer surface of the stile 6 and the body portion 24 seats against the outer surface of the rail 8 to engage the stile 6 and rail 8 firmly with the bracket 3. The stiles and rails are conventionally fabricated from steel or aluminum to provide a rigid frame while providing some degree of flexure to grip the panel securely. The bracket is conveniently stamped from sheet metal of about 0.030–0.050 inch thickness. The roller mounting member, roller and anti-jump member are conveniently molded from synthetic resin such as nylon, polypropylene and acetal.

What is claimed is:

1. A roller assembly for a sliding door which slides along a track formed with shoulders on either side of a central cavity, said roller assembly including:

(a) a bracket adapted for attachment to the door adjacent a bottom edge of the door, said bracket having a generally planar body portion;

(b) a roller mounting member slidably seated in said bracket, said roller mounting member having first and second side walls extending generally parallel to a plane in which said bracket body portion lies;

(c) a roller rotatably mounted on said roller mounting member for travel along the track, said roller being disposed between said first and second side walls and rotating about an axis perpendicular to the plane in which said bracket body portion lies, said roller having a median plane extending parallel to the plane in which said bracket body portion lies, said roller having a circular central portion providing a circumferential rim flanked by two coaxial circular side portions, each of said two coaxial circular side portions having a smaller diameter than a diameter of said central portion and being adapted to ride on a respective one of the shoulders of the track; and (d) a vertically and rotatably displaceable anti-jump member engageable with the shoulders of the track to prevent said roller from derailing, said anti-jump member including a handle adjacent an upper end of said anti-jump member, an elongated shaft extending downwardly from said handle, and an enlarged track engagement portion at a lower end of said anti-jump member, said engagement portion including elongated extensions which extend beyond a periphery of said shaft along a longitudinal axis which is perpendicular to an axis of said shaft, said anti-jump member being disposed with said shaft lying in the median plane of said roller and adjacent said central portion of said roller, said anti-jump member being pivotably and vertically displaceably carried by said roller mounting member for vertical movement relative to said roller mounting member between an operative lowered position wherein said engagement portion is extended downwardly with respect to said roller mounting member and rotated so that the longitudinal axis of said elongated extensions extends perpendicularly to said median plane and said elongated extensions are adapted to engage the shoulders of the track if said engagement portion is displaced upwardly relative to the track, and an elevated retracted position where said engagement portion is rotated so that said longitudinal axis of said elongated extensions is parallel to said median plane and is retracted upwardly with respect to the roller mounting member, the roller assembly being adapted to support the door as the door slides along the track with said anti-jump member in one of said operative lowered position and said elevated retracted position.

2. The roller assembly of claim 1 further comprising detent means on said shaft of said anti-jump member and said roller mounting member for releasably retaining said anti-jump member in said elevated retracted position and in said lowered operative position.

3. The roller assembly of claim 2 wherein said roller comprises a wheel and an axle, said wheel and said axle being integrally molded, and wherein said wheel includes said circular central portion.

4. The roller assembly of claim 1 wherein said roller mounting member, said roller and said anti-jump member are formed from a synthetic resin.

5. The roller assembly of claim 1 wherein said roller is snap fitted to said roller mounting member.

* * * * *